United States Patent [19]

Kawai et al.

[11] 4,176,629

[45] Dec. 4, 1979

[54] ELECTRIC CONTROL METHOD FOR FUEL INJECTION AND IGNITION TIMING

[75] Inventors: Hisasi Kawai, Toyohashi; Toshikazu Ina, Okazaki, both of Japan

[73] Assignee: Nippon Soken, Inc., Nishio, Japan

[21] Appl. No.: 856,509

[22] Filed: Dec. 1, 1977

[30] Foreign Application Priority Data

Dec. 10, 1976 [JP] Japan ..... 51-149030

[51] Int. Cl.[2] ..... F02B 41/00; F02B 13/00

[52] U.S. Cl. ..... 123/32 EC; 123/117 D; 123/32 EA

[58] Field of Search ..... 364/424, 426; 123/32 EA, 32 EB, 32 ED, 32 EC, 117 R, 117 D, 146.5 A

[56] References Cited

U.S. PATENT DOCUMENTS

| | | | |
|---|---|---|---|
| 3,835,819 | 9/1974 | Anderson, Jr. | 123/117 D |
| 3,898,962 | 8/1975 | Honig | 123/117 D |
| 3,903,857 | 9/1975 | Hönig | 123/117 D |
| 3,935,846 | 2/1976 | Zelenka | 123/32 EB |
| 3,969,614 | 7/1976 | Moyer | 123/117 D |
| 4,051,817 | 10/1977 | Hattori | 123/32 EA |
| 4,058,709 | 11/1977 | Long | 123/32 EA |

*Primary Examiner*—Jay P. Lucas

*Attorney, Agent, or Firm*—Cushman, Darby & Cushman

[57] ABSTRACT

In a method and apparatus for controlling a combustion engine, a digital computer is adapted to calculate first and second values corresponding to optimal settings of fuel injectors and spark plugs in a time sequence by detecting changes of the amount of air flowing into the engine and the rotation speed of the engine. The computer is programmed to calculate the first and second values from functions describing desired relationships among each setting of the fuel injectors and the spark plugs, the amount of air flowing into the engine and the rotation speed of the engine, thereby to eliminate a conventional negative pressure detecting element.

2 Claims, 24 Drawing Figures

200
BINARY COUNTER
DECADE COUNTER
BINARY COUNTER
SHIFT REGISTER
SHIFT REGISTER
SHIFT REGISTER
500Hz
520KHz
200a
200b
204
204a
205
206
207
208
209
210
211
212
213
214
215
216
217
218
219a
219b
219c
221
201
202
202a
203
2021
2022
2023
2024
2025
2121
2122
1b
X
a
b
c
d
e
f
g
h
i
j
k
l

ELECTRIC CONTROL METHOD FOR FUEL INJECTION AND IGNITION TIMING

BACKGROUND OF THE INVENTION

The present invention relates to an electronic control method and apparatus for a combustion engine, and more particularly to an improvement of a method and apparatus for controlling the combustion of air-fuel mixture in the engine in which a digital computer is employed to control the amount of fuel metered into the combustion chamber of the engine and the timing of sparks supplied to the engine in accordance with changes of the operating condition of the engine.

In a conventional electronic fuel injection control device, rotation speed of a crankshaft and the amount of air supplied to the engine are electrically detected as a main parameter to control the amount of fuel supplied to the engine, meanwhile in a conventional electronic spark timing control device, negative pressure in the intake manifold and rotation speed of a crankshaft are electrically detected as a main parameter to control the timing of sparks supplied to the engine. This means that in the case a digital computer is employed to operate both the fuel injection control device and the spark timing control device, it is required to provide at least three detecting elements for detecting changes of the operating condition of the engine.

SUMMARY OF THE INVENTION

It is, therefore, a primary object of the present invention to provide an electronic control device for a combustion engine in which the above-noted control devices are operated by a digital computer which is programmed to calculate first and second values corresponding to optimum settings of the control devices from functions describing desired relationships among each setting of the control devices, the amount of air supplied to the engine and rotation speed of the crankshaft, thereby to eliminate a negative pressure detecting element and possibly reduce the production cost.

For an actual practice of the present invention, characteristic curves illustrated in FIGS. 1 and 2 are experimentally obtained from optimum setting of the conventional fuel injection control device so that intake manifold negative pressure can be calculated from rotation speed of an engine and an amount of air flowing into the engine, as described below. In FIG. 1, the injection pulse-width $\tau$ in units of ms is plotted with a certain range in relation to the intake manifold absolute pressure P in units of mmHg, the pulse-width $\tau$ corresponding with the amount of fuel required to maintain a constant ratio of air and fuel. In FIG. 2, the correction factor $K_N$ is plotted in relation to the rotation speed N in units of $10^3$ r.p.m. The correction factor $K_N$ is adapted to obtain a standard characteristics from the characteristic curve of FIG. 1.

From the characteristic curves described above, the following equations may be indicated.

$$\tau = f_1(P', N) \quad (1)$$

$$P' = P_0 - P \quad (1a)$$

where P' is intake manifold negative pressure and $P_0$ is atmospheric pressure. As it is noted that the injection pulse-width $\tau$ is in proportion to the amount Q of air per one cranking rotation of the engine, the pulse-width $\tau$ may be represented as follows.

$$\tau \propto Q/N \quad (2)$$

where units of the amount Q is g/sec. Then, from the equations (1) and (2), $$Q/N = f_1(P', N) \quad (3)$$

Finally from the equation (3), $$P' = g_1(Q/N, N) = g_2(Q, N) \quad (4)$$

From the above description, it will be understood that the intake manifold negative pressure P' is calculated from two main parameters which are the amount of air and rotation speed of the engine.

According to the present invention briefly summarized, there is provided a method for controlling a combustion engine having an output shaft driven by mechanical energy converted from heat energy caused by the combustion of air-fuel mixture, the engine being provided thereon with first control means for controlling the amount of fuel metered into the engine and second control means for controlling the timing of the sparks supplied to the engine, the method comprising the steps of:

a. generating a binary number electric signal indicative of the amount of air flowing into the engine;

b. generating a binary number electric signal indicative of rotation speed of the output shaft during operation of the engine;

c. detecting a predetermined angular position of the output shaft before the arrival of a piston to its top dead center to generate a reference signal per one rotation of the output shaft;

d. generating a timing signal with a predetermined phase lag in relation to the reference signal;

e. calculating first and second values corresponding to respective settings of the first and second control means in a time sequence by a computer programmed to calculate the first and second values from a first function describing a desired relationship among setting of the first control means, the amount of air flowing into the engine and the rotation speed of the output shaft and from a second function describing another desired relationship among setting of the second control means, the amount of air flowing into the engine and the rotation speed of the output shaft, the calculations of the first and second values being respectively performed by using the binary number electric signals upon receiving the timing signal and the reference signal;

f. converting the first and second calculated values into the settings of the first and second control means respectively in response to the timing signal and the reference signal; and g. continuously repeating the above sequence of steps for controlling the amount of fuel and the timing of the sparks in response to changes in the binary number electric signals.

BRIEF DESCRIPTION OF THE DRAWINGS

Additional objects and advantages of the present invention will be more readily apparent from the following detailed description of a preferred embodiment thereof when taken together with the accompanying drawings in which.

DESCRIPTION OF THE PREFERRED EMBODIMENT

Figure 3:
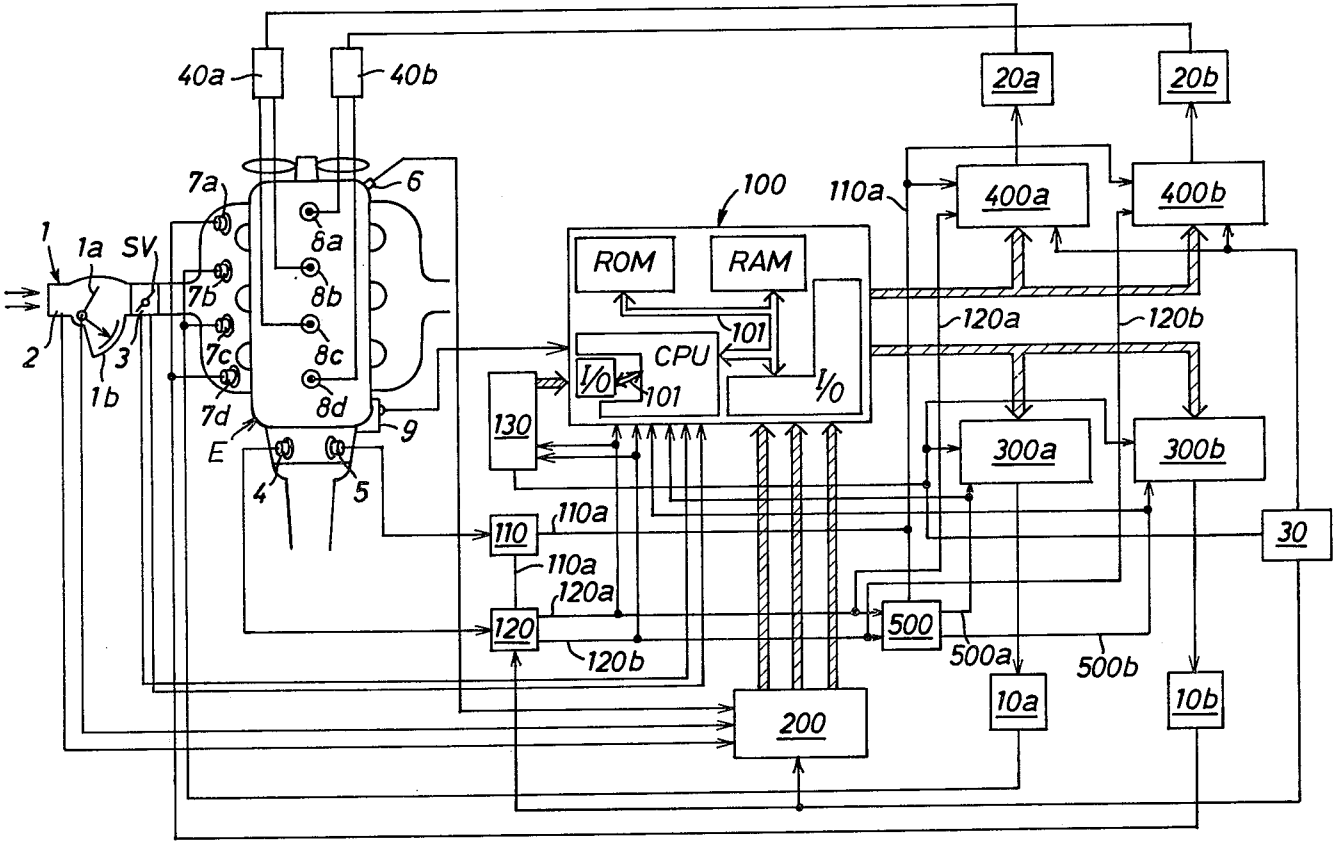
FIG. 3 is a schematic block diagram of an electronic control system for an internal combustion engine in accordance with the present invention.

Referring now to the accompanying drawings, in particular to FIG. 3, there is illustrated a schematic block diagram of an electronic control system for an internal combustion engine E in accordance with the present invention. The engine E is a four cylinder, four stroke internal combustion engine which includes four fuel injectors *7a* to *7d* mounted on an intake manifold and four spark plugs *8a* to *8d* mounted on a cylinder head. In operation of the combustion engine, the first and third cylinders are in their suction and exhaust strokes respectively when the second and fourth cylinders are respectively in their compression and power strokes. A crankshaft of the engine E rotates once per a reciprocation of a piston within each cylinder.

The electronic control system comprises various sensors to detect operating conditions of the internal combustion engine E. An air flow meter 1 is provided as one of sensors within an induction passage of the engine E and includes a static plate 1*a* and a potentiometer 1*b* of which the movable tap is coupled to the static plate 1*a* for detecting an amount of air sucked into the induction passage. When the static plate 1*a* is moved in proportion to the amount of the sucked air, an instant resistance value of the potentiometer 1*b* changes in proportion to the amount of the sucked air. The air flow meter 1 is provided with a temparature sensor 2 to detect temperature of the sucked air. A throttle position sensor 3 is provided within the induction passage and operatively connected to a throttle valve SV of the engine E. The throttle position sensor 3 generates a first signal therefrom for detecting an idle position of the throttle valve SV and a second signal therefrom for detecting a fully opened position of the valve SV. The first and second signals from the sensor 3 are applied directly to a digital computer 100. A suitable commercially available computer will be identified hereinafter and its functions will be described.

A reference pulse generator 4 and a crankshaft position sensor 5 are respectively mounted on the cylinder block of the engine E. The reference pulse generator 4 detects an angular position of the crankshaft before the arrival of a first piston to its top dead center to generate a reference pulse per one crankshaft rotation. On the other hand, the crankshaft position sensor 5 detects rotation speed of the crankshaft to generate angular pulses at a frequency proportional to the rotation speed of the crankshaft. A coolant temperature sensor 6 is mounted on the cylinder block of the engine E to detect coolant temperature of the engine E, and a starter switch 9 is mounted on the cylinder block to detect start of the engine E.

The electronic control system further comprises an analog-to-digital converter 200 which is connected to the potentiometer 1*b*, the temperature sensor 2 and the coolant temperature sensor 6. The converter 200 receives respective output signals from the potentiometer 1*b*, the temperature sensor 2 and the coolant temperature sensor 6 to convert them into binary signals in response to clock pulses issued from a clock circuit 30. The binary signals from the converter 200 are transferred to the computer 100. In the electronic control system, a wave shaping circuit 110 is connected to the crankshaft position sensor 5 to receive therein the angular pulses from the sensor 5. Each of the angular pulses is reshaped by the wave shaping circuit 110 into a rectangular pulse which is applied through a line 110*a* to an electronic distributor 120, comparators 400*a* and 400*b*, and a delay circuit 500.

The electronic distributor 120 is connected to the reference pulse generator 4 to receive the reference pulse from the generator 4. The reference pulse is modulated by the distributor 120 into a pair of first and second output pulses in response to rectangular pulses from the wave shaping circuit 110 and clock pulses from the clock circuit 30. The first and second output pulses are applied through lines 120*a* and 120*b* to the computer 100 as trigger signals and also to a rotation speed detector 130 and the delay circuit 500. The first output pulse of the distributor 120 is further applied through the line 120*a* to the comparator 400*a* as a trigger signal, whereas the second output pulse is further applied through the line 120*b* to the comparator 400*b* as a trigger signal. The rotation speed detector 130 is operated by clock pulses from the clock circuit 30 to convert each period of the first and second output pulses from the distributor 120 into each reciprocal of rotation number. The reciprocal of the rotation number is applied to the computer 100 as binary signals. The delay circuit 500 functions to delay the first and second output pulses from the distributor 120 with a predetermined phase angle in response to rectangular pulses from the wave shaping circuit 110, thereby to generate first and second timing pulses for triggering the computer 100 and comparators 300*a* and 300*b* respectively.

The digital computer 100 comprises a central processing unit or CPU which is connected by way of a data bus 101 to an input-output device or I/O, a read only memory or ROM and a random access memory or RAM. I/O receives binary signals issued from the rotation speed detector 130 and the analog-to-digital converter 200 to temporarily memorize them in RAM. The memorized binary signals in RAM are selectively read out and applied by I/O to CPU through the data bus 101. In the embodiment, first and second programs are previously stored within ROM so that CPU calculates a first data from a first function describing a desired relationship between operating conditions of the engine E and optimum settings of the fuel injectors 7*a* to 7*d* and also calculates a second data from a second function describing a desired relationship between operating conditions of the engine E and optimum settings of the spark plugs 8*a* to 8*d*. The desired relationships noted above are determined experimentally and memorized in ROM by means of the programs. CPU is triggered by receiving the first and second timing pulses from the delay circuit 500 to start calculation of the first data for controlling the fuel injectors 7*a* to 7*d*. CPU is also triggered by receiving the first and second output pulses from the electronic distributor 120 to start calculation of the second data for controlling the spark plugs 8*a* to 8*d*. The calculation of the first and second data in CPU are respectively executed in a timesharing method by using binary signals from I/O by means of programming in ROM. The calculated first and second data are respectively transferred as binary numbers to the comparators 300*a* and 300*b* and to the comparators 400*a* and 400*b* by means of I/O.

The comparator 300*a* is connected through a line 500*a* to the delay circuit 500 to be triggered upon receiving the first timing pulse from the delay circuit 500. The first data calculated in the computer 100 is converted by the comparator 300*a* into a first output pulse with a corresponding pulse-width in response to clock pulses from the clock circuit 30. The first output pulse from the comparator 300*a* is applied to an injector drive circuit 10*a* which drives the second and third fuel injectors 7*b* and 7*c*. Meanwhile, the comparator 300*b* is connected through a line 500*b* to the delay circuit 500 to be triggered upon receiving the second timing signal from the delay circuit 500. The calculated first data is also converted into a second output pulse with a corresponding pulse-width in response to clock pulses form the clock circuit 30. The second output pulse from the comparator 300*b* is applied to an injector drive circuit 10*b* which drives the first and fourth injectors 7*a* and 7*d*.

The comparator 400*a* is connected through the line 120*a* to the electronic distributor 120 to be triggered upon receiving the first output pulse from the distributor 120. The second data calculated in the computer 100 is converted by the comparator 400*a* into a first spark advance signal in response to clock pulses from the clock circuit 30 and rectangular pulses from the wave shaping circuit 110. The first spark advance signal from the comparator 400*a* is applied to an ignitor 20*a* which energizes an ignition coil 40*a* so as to activate the second and third spark plugs 8*b* and 8*c*. Meanwhile, the comparator 400*b* is connected through the line 120*b* to the distributor 120 to be triggered upon receiving the second output pulse from the distributor 120. The calculated second data is converted by the comparator 400*b* into a second spark advance signal in response to clock pulses from the clock circuit 30 and the rectangular pulses from the wave shaping circuit 110. The second spark advance signal from the comparator 400*b* is applied to an ignitor 20*b* which energizes an ignition coil 40*b* so as to activate the first and fourth spark plugs 8*a* and 8*d*.

Figure 4:
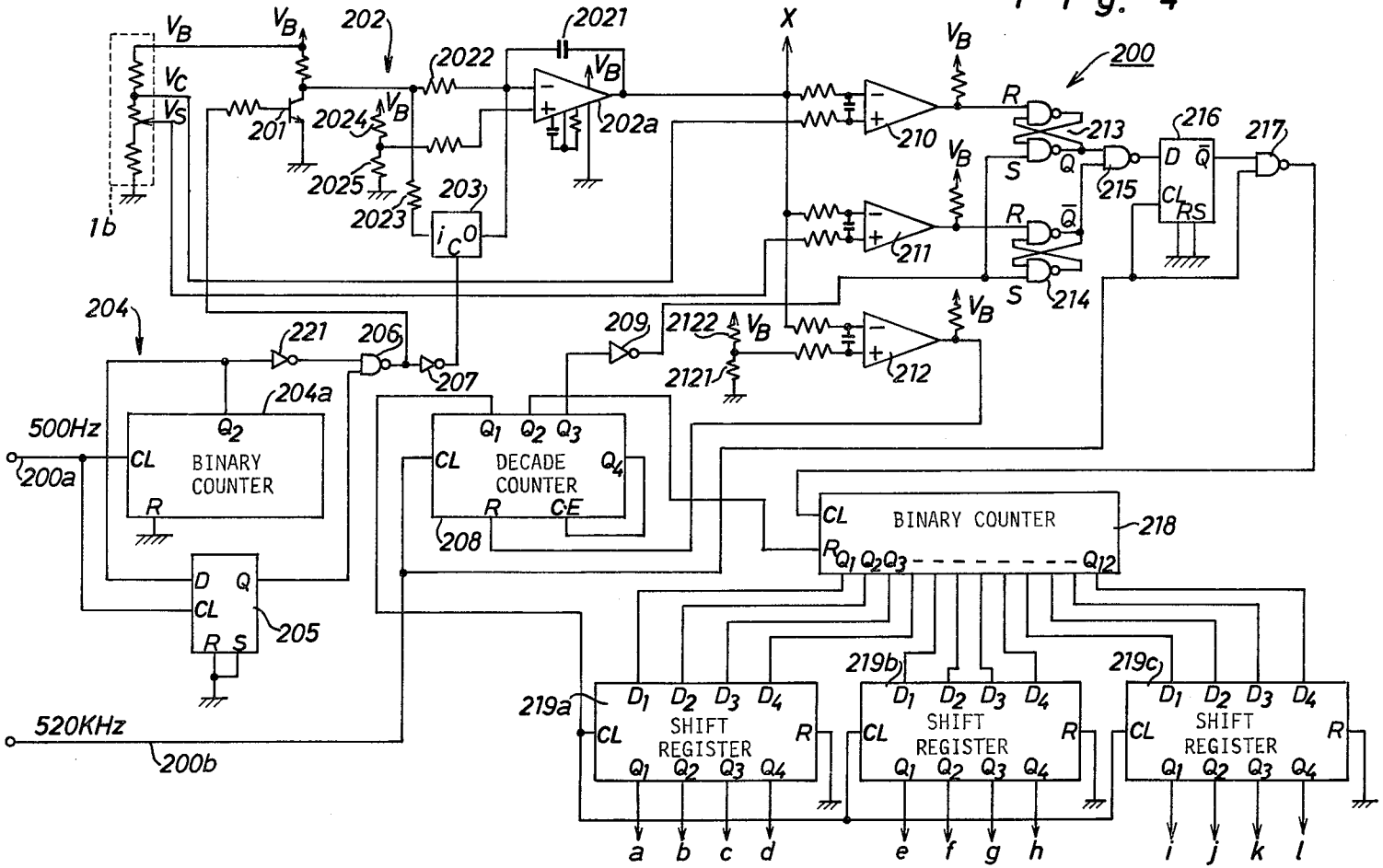
FIG. 4 is a circuit diagram of an embodiment of the analog-to-digital converter illustrated in block form in FIG. 3.

In FIG. 4, there is illustrated an embodiment of the analog-to-digital converter 200 which comprises an integrator 202 driven by a drive circuit 204. The drive circuit 204 includes a binary counter 204*a* of CD 4040 type, which is manufactured by RCA Corporation in U.S.A., to receive at its terminal CL clock pulses shown in (a) of FIG. 5 from the clock circuit 30 through a line 200*a*. Then, the binary counter 204*a* divides each clock pulse into $\frac{1}{4}$ in frequency to generate at its terminal $Q_2$ output pulses which are applied to an inverter 221 and a D flip-flop 205. The D flip-flop 205 delays each output pulse from the counter 204*a* by a half period of the clock pulse in phase to generate delayed output pulses at its terminal Q. A NAND gate 206 receives output pulses inverted by the inverter 221 and delayed output pulses from the D flip-flop 205 to generate at its output terminal output pulses shown in (b) of FIG. 5.

Figure 5:
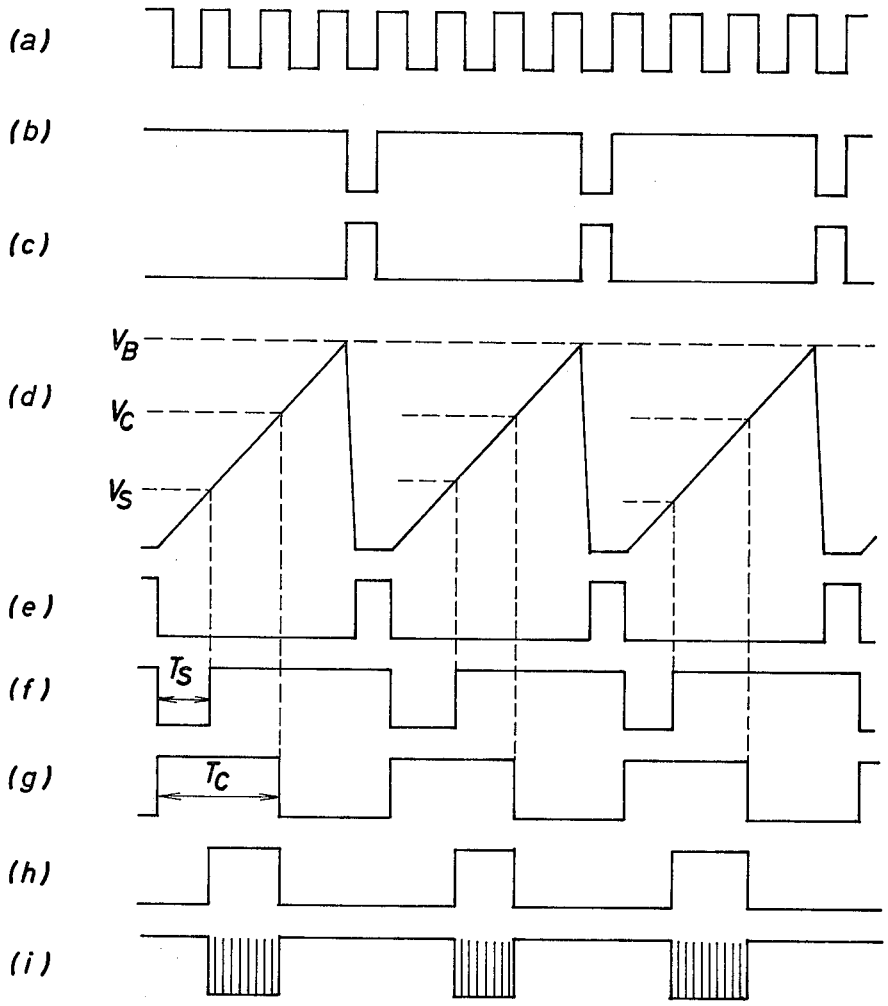
FIG. 5, including *a–i*, illustrates waveforms obtained at various points in the analog-to-digital converter.

The integrator 202 is designed to obtain saw-toothed wave signals shown in (d) of FIG. 5 from the output pulses of the NAND gate 206. When a transistor 201 receives at its base a high level signal from the NAND gate 206, it is turned on to generate at its collector a low level signal. The low level signal of the transistor 201 is applied to a first input terminal of an operational amplifier 202*a* through a resistor 2022 and to an input terminal i of an analog switch 203 through a resistor 2023. The amplifier 202*a* and the analog switch 203 are respectively of CA 3130 type and CD 4066 type manufactured by RCA Corporation. The amplifier 202*a* also receives at its second input terminal a predetermined voltage $V_B/2$ divided by a divider comprising resistors 2024 and 2025. Thus, the amplifier 202*a* compares the low level signal from the transistor 201 with the voltage $V_B/2$ to produce an upward going waveform in the saw-toothed wave signal, as shown in (d) of FIG. 5. In this instance, the analog switch 203 receives at its control terminal C a low level signal shown in (c) of FIG. 5 which is inverted by an inverter 207 from the high level signal of the NAND gate 206. Thus, the analog switch 203 is turned off to form a predetermined long time constant defined by a condenser 2021 and the resistor 2022.

When the transistor 201 receives at its base a low level signal from the NAND gate 206, it is turned off to generate at its collector a high level signal. Then, the high level signal of the transistor 201 is applied to the first input terminal of the amplifier 202*a* through the resistor 2022 and to the input terminal i of the analog switch 203 through the resistor 2023. The amplifier 202*a* compares the high level signal of the transistor 201 with the voltage $V_B/2$ to produce a downward-going waveform in the saw-toothed wave signal, as shown in (d) of FIG. 5. In this instance, the analog switch 203 receives at its control terminal C a high level signal shown in (c) of FIG. 5 which is inverted by the inverter 207 from the low level signal of the NAND gate 206. Thus, the switch 203 is turned on to form a predetermined short time constant defined by the condenser 2021 and the resistors 2022 and 2023. In addition, a resistance value of the resistor 2023 is very smaller than that of the resistor 2022.

The analog-to-digital converter 200 also comprises a comparator 212 for detecting a leading edge of the saw-toothed wave signal in (d) of FIG. 5. The comparator 212 receives at its first input terminal the saw-toothed wave signal from the integrator 202 and at its second input terminal a predetermined voltage of about 0 (V) defined by a divider including resistors 2121 and 2122. Thus, the comparator 212 detects a leading edge of the saw-toothed wave signal to generate an output pulse shown in (e) of FIG. 5 which is applied as a reset signal to a terminal R of a decade counter 208 of CD 4017 type manufactured by RCA Corporation. The counter 208 also receives at its terminal CL clock pulses from the clock circuit 30 through a line 200*b* to count them in response to the output pulse from the comparator 212. Immediately after the counter 208 is released from its reset condition at a trailing edge of the output pulse from the comparator 212, it generates output pulses at its respective terminals $Q_1$, $Q_2$ and $Q_3$ in sequence.

The converter 200 further comprises two comparators 210 and 211 and two RS flip-flops 213 and 214. The comparator 210 receives at its input terminals the saw-toothed wave signal from the integrator 202 and a predetermined voltage $V_c$ from the potentiometer 1*b* of the air flow meter 1. While the saw-toothed wave signal is smaller than the predetermined voltage $V_c$, the comparator 210 generates at its output terminal a high level signal which is applied to a reset terminal of the RS flip-flop 213. When the saw-toothed wave signal increases up to the predetermined voltage $V_c$, a low level signal appears at the output terminal of the comparator 210 and is applied to the reset terminal of the RS flip-flop 213. The comparator 211 receives at its input terminals the saw-toothed wave signal and a detected voltage $V_s$ from the potentiometer 1*b*. While the saw-toothed wave signal is smaller than the detected voltage $V_s$, the comparator 211 generates at its output terminal a high level signal which is applied to a reset terminal of the RS flip-flop 214. When the saw-toothed wave signal increases up to the voltage $V_s$, the comparator 211 generates at its output terminal a low level signal which is applied to the reset terminal R of the RS flip-flop 214.

The RS flip-flops 213 and 214 are respectively set in response to an output pulse of an inverter 209 which is inverted from the output pulse appearing at the terminal $Q_3$ of the counter 208. Then, the RS flip-flop 213 generates at its terminal Q a high level signal with a duration $T_c$ shown in (g) of FIG. 5, whereas the RS flip-flop 214 generates at its terminal $\overline{Q}$ a low level signal with a duration $T_s$ shown in (f) of FIG. 5. When the RS flip-flop 213 is reset in response to the low level signal from the comparator 210, it generates a low level signal at its terminal Q shown in (g) of FIG. 5. When the RS flip-flop 214 is reset in response to the low level signal from the comparator 211, it generates a high level signal at its terminal Q shown in (f) FIG. 5. Then, a NAND gate 215 receives at its input terminals the low and high level signals from the RS flip-flops 213 and 214 to generate a low level signal which is applied to a terminal D of a D flip-flop 216. When the D flip-flop 216 also receives at its terminal CL clock pulses from the clock circuit 30 through the line 200*b*, it generates at its terminal $\overline{Q}$ a high level signal with a duration $(T_c-T_s)$ shown in (h) of FIG. 5.

In the converter 200, to convert the high level signal of the D flip-flop 216 into a binary signal, there are provided a NAND gate 217, a binary counter 218 and three parallel-in parallel-out shift registers 219*a*, 219*b* and 219*c*. The counter 218 and the shift registers 219*a*, 219*b* and 219*c* are respectively of CD 4040 type and CD 4035 type manufactured by RCA Corporation. The NAND gate 217 receives at its input terminals the high level signal from the D flip-flop 216 and clock pulses from the clock circuit 30 through the line 200*b* to generate at its output terminal sequential output pulses as shown in (i) of FIG. 5. When the binary counter 218 receives at its terminal CL the sequential output pulses from the NAND gate 217, it generates at its terminals $Q_1$ to $Q_{12}$ each output signal in response to the pulse appearing at the terminal $Q_2$ of the decade counter 208. The shift registers 219*a* to 219*c* receive each output signal from the counter 218 to generate at their terminals $Q_1$ to $Q_4$ each output signal. Each output signal of the registers 219*a* to 219*c* is applied as a binary number to the computer 100 through lines a to l.

In the above description, the predetermined voltage $V_c$ and the detected voltage $V_s$ are related with an amount Q of air flowing through the air flow meter 1 as the following equation (5).

$$Q=K/(V_c-V_s)/V_B=K/U_1/U_2 \tag{5}$$

$V_B$: a voltage of an electric source

K: proportional constant

Since a voltage of the saw-toothed wave signal is proportional in time, as clearly understood from (d) of FIG. 5, the following equations are obtained in relation to the above-noted equation (5).

$$T_s \propto V_s/V_B,\ T_c \propto V_c/V_B \tag{6}$$

$$U_1/U_2=(V_c/V_B)-(V_s/V_B) \propto T_c-T_s \tag{7}$$

Thus, it will be understood that the amount Q of air is in proportion to $1/(T_c-T_s)$ because $U_1/U_2$ is in proportion to $(T_c-T_s)$. As a result, the amount Q of air is detected by the converter 200 as a digital signal which has a duration $(T_c-T_s)$ inversely proportional to the amount Q.

Furthermore, output signals from the air temperature sensor 2 and the coolant temperature sensor 6 may be converted into digital signals by the analog-to-digital converter 200. In this case, another comparators are preferably provided to compare the saw-toothed wave signal from the integrator 202 with output signals from the air temperature sensor 2 and the coolant temperature senser 6.

Figure 6:
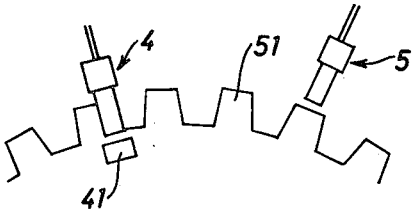
FIG. 6 illustrates embodiments of the reference pulse generator and the crankshaft position sensor shown in FIG. 3.

In FIG. 6, there are illustrated embodiments of the reference pulse generator 4 and the crankshaft position sensor 5. The reference pulse generator 4 is a magnetic pick-up which is located in magnetic coupling relationship with an iron tip 41. The iron tip 41 is secured to a ring gear 51 of the crankshaft at a reference position corresponding with 60 degrees before the top dead center position of the piston for the first cylinder. Thus, the reference pulse generator 4 detects the reference position in response to rotation of the iron tip 41 to generate a reference pulse per one crankshaft rotation. The crankshaft position sensor 5 is a magnetic pick-up which is located in magnetic coupling relationship with each tooth of the ring gear 51. The ring gear 51 has one hundred and fifteen teeth to generate one hundred and fifteen angular pulses per one crankshaft rotation.

Figure 7:
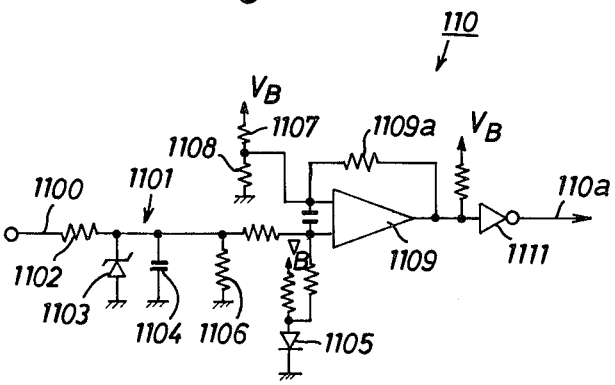
FIG. 7 is a circuit diagram of an embodiment of the wave shaping circuit illustrated in block form in FIG. 3.

FIG. 7 illustrates an embodiment of the wave shaping circuit 110 which comprises a clamper 1101 composed of a zener diode 1103, resistors 1102 and 1106, and a condenser 1104. The clamper 1101 receives angular pulses from the crankshaft position sensor 5 at its input terminal to clamp the angular pulses. The clamped angular pulses are applied to a second input terminal of a comparator 1109 of MC 3302 type manufactured by Motorola Semiconductor Products Incorporation in U.S.A. The comparator 1109 receives at its first input terminal a voltage divided by a divider including resistors 1107 and 1108, and also receives at its second input terminal a forward voltage defined by a diode 1105, the two bias voltages being substantially the same to each other. Thus, the clamped pulses from the clamper 1101 are inverted by the comparator 1109 and then further inverted by an inverter 1111. The inverted pulses from the inverter 1111 are finally applied as rectangular pulses to the distributor 120, the comparators **400*a* and 400*b*, and the delay circuit 500. In the comparator 1109, a positive feedback resistor 1109*a*** functions to sharply reshape leading and trailing edges of each rectangular pulse.

Hereinafter, an embodiment of the electronic distributor 120 will be described in detail. The distributor 120 comprises a wave shaping circuit having the same construction as the wave shaping circuit 110, and a distributing circuit 120A shown in FIG. 8. The wave shaping circuit receives the reference pulse from the reference pulse generator 4 to reshape the same which is applied to the distributing circuit 120A as a reshaped signal shown in (a) of FIG. 9.

Figure 8:
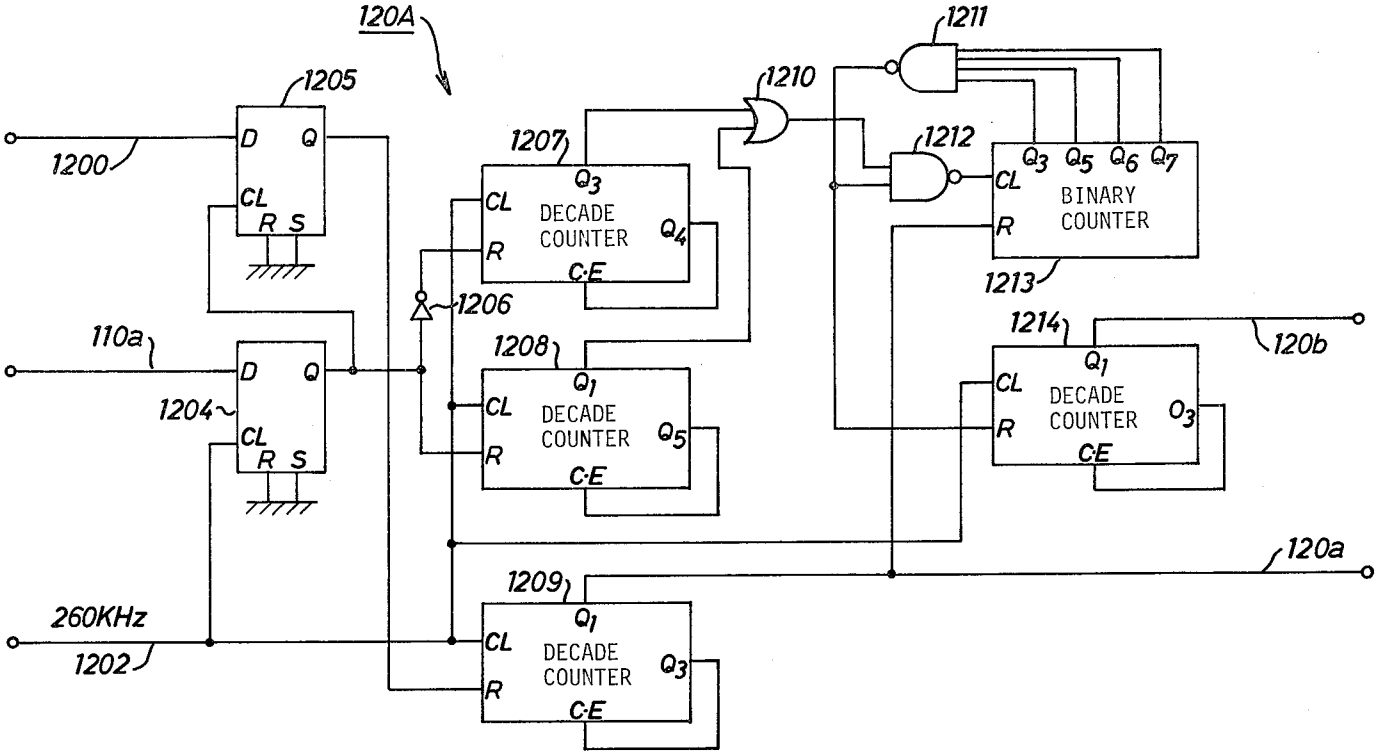
FIG. 8 is a circuit diagram of an embodiment of a distributing circuit; the distributing circuit being included in the electronic distributor shown in block form in FIG. 3.

In FIG. 8, the distributing circuit 120A comprises two D flip-flops 1204 and 1205, and a decade counter 1209 of CD 4017 type manufactured by RCA Corporation. The D flip-flop 1204 receives at its terminal CL clock pulses from the clock circuit 30 through a line 1202 and also receives at its terminal D the rectangular pulses from the wave shaping circuit 110 shown in (b) of FIG. 9 through the line **110*a*. Thus, the D flip-flop 1204 generates at its terminal Q output pulses in response to the clock pulses. The D flip-flop 1205 receives at its terminal CL the output pulses from the D flip-flop 1204 and also receives at its terminal D the reshaped signal from the wave shaping circuit of the distributor 120. Then, the D flip-flop 1205 generates at its terminal Q an output pulse shown in (c) of FIG. 9 in response to the output pulses from the D flip-flop 1204. The decade counter 1209 receives at its terminal CL the clock pulses from the clock circuit 30 through the line 1202 and also receives at its terminal R the output pulse from the D flip-flop 1205. The counter 1209 generates at its terminal $Q_1$ an output pulse shown in (d) of FIG. 9 in response to a trailing edge of the output pulse shown in (c) of FIG. 9. Thus, the output pulse of the counter 1209 is applied as a first output pulse to the computer 100, the rotation speed detector 130, the comparator 400*b* and the delay circuit 500 through the line 120*a***.

Furthermore, the distibuting circuit 120A comprises an inverter 1206, two decade counters 1207 and 1208, and an OR gate 1210. The inverter 1206 receives the output pulses from the D flip-flop 1204 to invert the same which is applied to a terminal R of the counter 1207. When the counter 1207 receives at its terminal CL the clock pulses from the clock circuit 30 through the line 1202, it generates at its terminal $Q_3$ an output pulse in response to a leading edge of the output pulse from the wave shaping circuit 110 shown in (b) of FIG. 9. Meanwhile, the counter 1208 directly receives at its terminal R the output pulses from the D flip-flop 1204 and also receives at its terminal CL the clock pulses from the clock circuit 30. Then, the counter 1208 generates at its terminal $Q_1$ an output pulse in response to a trailing edge of the output pulse from the circuit 110 shown in (b) of FIG. 9. The OR gate 1210 receives at its input terminals the output pulses from the counters 1207 and 1208 to generate output pulses shown in (e) of FIG. 9. The output pulses from the OR gate 1210 are applied through a NAND gate 1212 to a binary counter 1213 of CD 4040 type manufactured by RCA Corporation.

When the binary counter 1213 is reset upon receiving at its terminal R the output pulse from the counter 1209, it generates low level signals at its respective terminals $Q_3$, $Q_5$, $Q_6$ and $Q_7$ and simultaneously count one output pulse previously issued from the NAND gate 1212, as described below. Thereafter, the counter 1213 receives at its terminal CL sequential output pulses from the NAND gate 1212 and counts them up to one hundred and fifteen to generate high level signals at its terminals $Q_3$, $Q_5$, $Q_6$ and $Q_7$. In other words, the counter 1213 counts at its terminal CL one hundred and sixteen output pulses from the NAND gate 1212 to generate the high level signals at its terminals $Q_3$, $Q_5$, $Q_6$ and $Q_7$.

Figure 9:
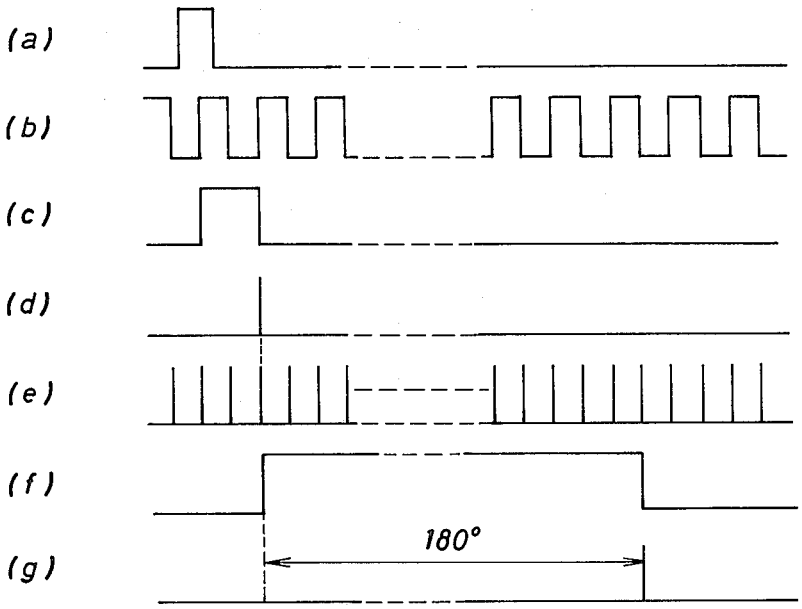
FIGS. 9 (including *a–g*, and 10, including *a–b* respectively illustrate waveforms obtained at various points in the distributor.

A NAND gate 1211 receives at its input terminals the low level signals from the counter 1213 to generate at its output terminal a high level signal shown in (f) of FIG. 9. The NAND gate 1211 also receives at its input terminals the high level signals from the counter 1213 to generate at its output terminal a low level signal shown in (f) of FIG. 9. The NAND gate 1212 receives at its input terminals the sequential output pulses from the OR gate 1210 and the high level signal from the NAND gate 1211 to generate sequential output pulses at its output terminal. The NAND gate 1212 also receives at its input terminals the sequential output pulses from the OR gate 1210 and the low level signal from the NAND gate 1211 to generate at its output terminal an output pulse for stopping counting function of the counter 1213. A decade counter 1214 is reset upon receiving at its terminal R the high level signal from the NAND gate 1211 and thereafter receives at its terminal R the low level signal from the NAND gate 1211. Then, the counter 1214 is released from its reset condition to generate an output pulse at its terminal $Q_1$. The output pulse from the counter 1214 is applied as a second output pulse to the computer 100, the rotation speed detector 130, the comparator **400*a* and the delay circuit 500 through the line 120*b***.

Figure 10:
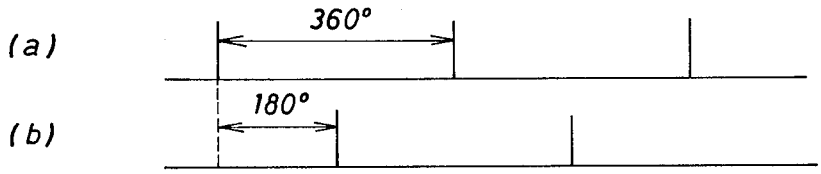

With the electronic distributor 120 described above, it will be understood that the first and second output pulses are respectively generated once per a crankshaft rotation as shown in (a) and (b) of FIG. 10, and the second output pulse generates with a 180° phase lag in relation to the first output pulse.

Figure 11:
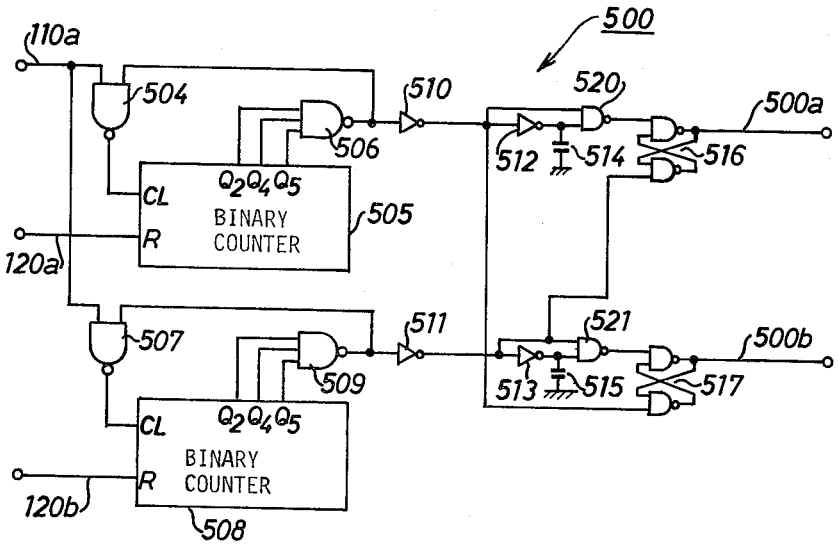
FIG. 11 is a circuit diagram of an embodiment of the delay circuit illustrated in block form in FIG. 3.

FIG. 11 illustrates an embodiment of the delay circuit 500 which is designed to respectively generate first and second timing pulses with approximate 81° phase lag in relation to the first and second output pulses of the distributor 120. The delay circuit 500 comprises a binary counter 505 of CD 4040 type manufactured by RCA Corporation. The binary counter 505 is reset upon receiving at its terminal R a first output pulse (See (a) of FIG. 12) from the distributor 120 through the line 120*a* to generate low level signals at its terminals $Q_2$, $Q_4$ and $Q_5$ respectively. When the counter 505 receives at its terminal CL sequential output pulses from a NAND gate 504, as described below, it counts them up to twenty-six in response to the first output pulse from the distributor 120 to generate at its terminals $Q_2$, $Q_4$ and $Q_5$ high levle signals respectively. A NAND gate 506 receives at its input terminals the low level signals from the counter 505 to generate at its output terminal a high level signal which is applied to the NAND gate 504 and an inverter 510. The NAND gate 506 also receives at its input terminal the high level signals from the counter 505 to generate at its output terminal a low level signal which is applied to the NAND gate 504 and the inverter 510.

The NAND gate 504 receives at its input treminals the high level signal from the NAND gate 506 and rectangular pulses from the wave shaping circuit 110 through the line 110*a* to generate at its output terminal sequential output pulses. The NAND gate 504 also receives at its input terminals the low level signal from the NAND gate 506 and the rectangular pulses from the circuit 110 to generate at its output terminal a output pulse for stopping counting function of the counter 505. On the other hand, the inverter 510 receives at its input terminal the high level signal from the NAND gate 506 to generate at its output terminal a low level signal shown in (c) of FIG. 12. The inverter 510 also receives at its input terminal the low level signal from the NAND gate 506 to generate at its output terminal a high level signal shown in (c) of FIG. 12. In this case, the low level signal of the inverter 510 has a duration corresponding with a phase angle of approximate 81° which is obtained from 360 (degree)×26 (pulse number)/115 (tooth number).

The delay circuit 500 further comprises a NAND gate 520 which receives at its first input terminal the output signal from the inverter 510 and also receives at its second input terminal the same signal through an inverter 512 and a condenser 514. The inverter 512 and the condenser 514 function to delay the output signal of the inverter 510 by a predetermined angle in phase. When the low level signal is issued from the inverter 510, the NAND gate 520 generates a low level signal at a trailing edge of the low level signal of the inverter 510. The RS flip-flop 516 receives at its set terminal the low level signal from the NAND gate 520 to generate at its output terminal a high level signal shown in (e) of FIG. 12. The RS flip-flop 516 also receives at its reset terminal the low level signal from an inverter 511, as described below, to generate at its output terminal a low level signal shown in (e) of FIG. 12. The output signal of the RS flip-flop 516 is applied as a first timing signal to the computer 100 and the comparator 300*a*.

Figure 12:
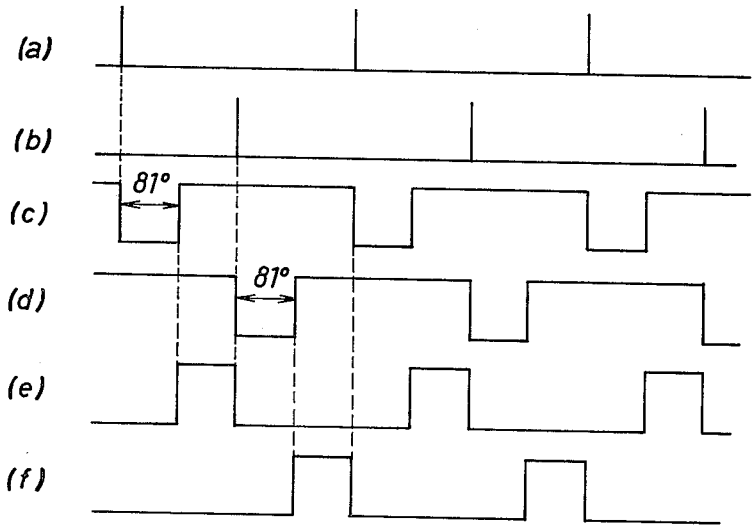
FIG. 12, including *a–f*, illustrates waveforms obtained at various points in the delay circuit.

In the delay circuit 500, two NAND gates 507 and 509 and a binary counter 508 are provided to obtain low and high level signals from the rectangular pulses of the wave shaping circuit 110 and the second output pulse of the distributor 120 shown in (b) of FIG. 12. The inverter 511 receives at its input terminal the high level signal from the NAND gate 509 to generate at its output terminal a low level signal shown in (d) of FIG. 12. The inverter 511 also receives at its input terminal the low level signal to generate at its output terminal a high level signal shown in (d) of FIG. 12. The low and high level signals in (d) of FIG. 12 respectively delay by 180° in phase from the low and high level signals in (c) of FIG. 12. Other functions of the elements 507, 508 and 509 are substantially the same as that of the NAND gates 504 and 506 and the counter 505.

Furthermore, in the circuit 500, an inverter 513, a condenser 515, a RS flip-flop 517 and a NAND gate 521 are provided to obtain low and high level signals shown in (f) of FIG. 12 from the output pulses of the inverters 510 and 511. Other function of these elements 513, 515, 517 and 521 is substantially the same as that of the inverter 512, the condenser 514, the RS flip-flop 516 and the NAND gate 520. The output signal from the RS flip-flop 517 is applied as a second timing signal to the computer 100 and the comparator 300*b*.

Figure 13:
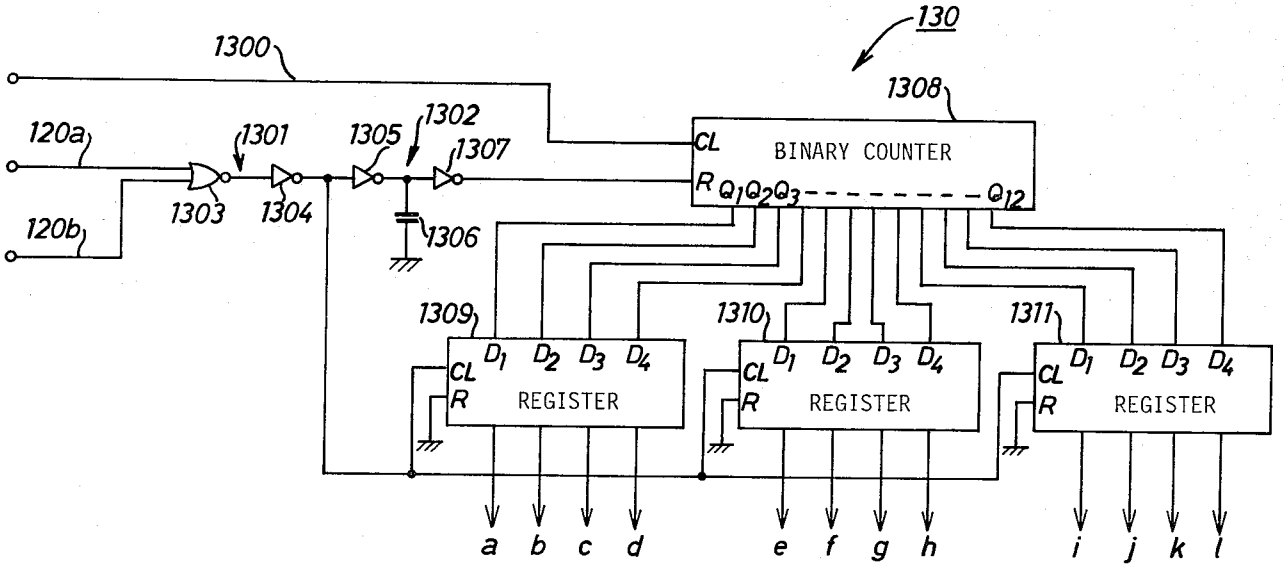
FIG. 13 is a circuit diagram of an embodiment of the rotation speed detector illustrated in block form in FIG. 3.

FIG. 13 illustrates an embodiment of the rotation speed detector 130 in which an OR circuit 1301 is composed of a NOR gate 1303 and an inverter 1304. The OR circuit 1301 receives at its input terminals first and second output pulses from the distributor 120 to generate at its output terminal an output pulse per a half crankshaft rotation. The output pulse from the OR circuit 1301 is applied to a delay circuit 1302 and parallel-in parallel-out shift registers 1309 to 1311 of CD 4035 type manufactured by RCA Corporation. The shift registers 1309 to 1311 are repetitively reset upon receiving at their terminals CL each output pulse from the OR circuit 1301 to memorize therein output pulses previously appearing at respective terminals $Q_1$ and $Q_{12}$ of a binary counter 1308. The output pulses memorized in the registers 1309 to 1311 are binary numbers proportional to a reciprocal of instant rotation number N and respectively applied to the digital computer 100 through lines a to l. The delay circuit 1302 comprises a condenser 1306 and inverters 1305 and 1307 to receive at its input terminal the output pulse from the OR circuit 1301. Then, the output pulse is delayed by the delay circuit 1302 with a predetermined angle in phase and thereafter applied as a reset signal to a terminal R of the counter 1308. The counter 1308 receives at its terminal CL clock pulses from the clock circuit 30 through a line 1300 to repetitively count them in response to each reset signal from the delay circuit 1302. Then, each counted result appears at the output terminals $Q_1$ to $Q_{12}$ of the counter 1308 and is applied to the shift registers 1309 to 1311.

Hereinafter, an embodiment of the digital computer 100 will be described in detail. In a practice of the present invention, a MICROCOMPUTER of TLCS-12A type manufactured by TOKYOSHIBAURA ELECTRIC COMPANY in Japan has been used as the digital computer 100. Detailed information concerning this computer is presented in a book entitled "TLCS-12A TOSHIBA LSI COMPUTER SYSTEM" (Second Edition) published by the Toshiba Electric Company of Japan. Service routine of the MICROCOMPUTER will be mainly described with reference to FIGS. 1, 2 and 14 to 18, the particular construction and programming process of the MICROCOMPUTER being well known in prior arts.

1. Computer Calculation of First Data for Fuel Injectors

Figure 14:
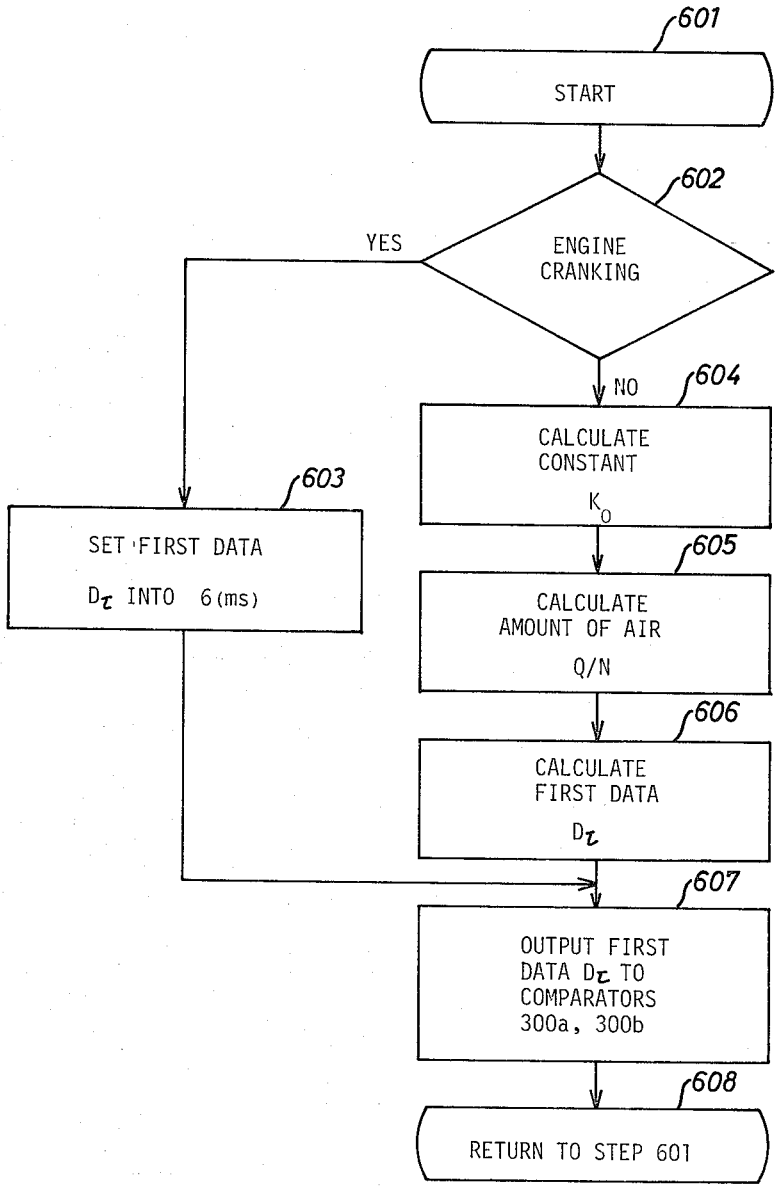
FIG. 14 is a flow diagram illustrating the operation of the digital computer as it is used to control fuel metering in the engine.

A first data $D_\tau$ for the fuel injectors *7a* to *7d* is calculated by the digital computer 100 from the following relationship:

$$D_\tau = K_0 \cdot (Q/N) \quad (8)$$

$$K_0 = W \cdot A \cdot S \cdot (K + D_1 + D_p) \quad (8a)$$

where $K_0$ is a proportional constant and where Q/N is an amount Q of sucked air/rotation number N. Each factor included in the constant $K_0$ represents the following:

W: correction-factor indicating amount of fuel increasing in relation with coolant temperature A: correction-factor indicating amount of fuel increased in relation with sucked air temperature S: correction-factor indicating amount of fuel increased in relation with coolant temperature and lapse of time after start of engine E K: constant given from basic mixture ratio of air and fuel $D_1$: correction-factor indicating amount of fuel increased in relation with coolant temperature under idle position of the throttle valve SV $D_p$: correction-factor indicating amount of fuel increased under fully opened position of the valve SV The above relationship is memorized in ROM of the computer 100 and used at steps in a flow diagram shown in FIG. 14 which illustrates the calculation of the first data. The computer program is entered at a step 601 when CPU is triggered by the first timing signal from the delay circuit 500. At a step 602, a determination is made as to whether the engine E is cranked or not. To make this determination, CPU receives an output signal from the starter switch 9 through I/O and determines whether a level of the output signal is greater than a predetermined value or not. If the answer to this question is "yes", then the engine is cranked and the program proceeds to a step 603. At this step 603, the first data $D_\tau$ is set to a predetermined value 6 (ms), and thereafter at a step 607, the first data $D_\tau$ is transferred to the comparators 300*a* and 300*b* by I/O.

If the answer to the above question is "no", indicating the completion of cranking of the engine E, the program proceeds to a step 604. At the step 604, CPU receives the first signal from the throttle position sensor 3 to make a determination as to whether the engine is in a idle operation or not. If the engine is in the idle operation, CPU reads out the constant K and the amount $D_1$ of fuel. The constant k and the amount $D_1$ of fuel are added to each other in CPU and temporarily memorized as a value $K_1$. If the throttle valve SV is not in the idle position, only the constant K is temporarily memorized as a value $K_1$. Subsequently, CPU receives the second signal from the throttle position sensor 3 to make a determination as to whether the throttle valve SV is in fully opened position or not. If the throttle valve SV is in fully opened position, CPU reads out of the above value $K_1$ and the amount $D_p$ of fuel. The value $K_1$ and the amount $D_p$ of fuel are added to each other in CPU and then temporarily memorized as a value $K_2$. If the throttle valve SV is not in fully opened position, CPU receives an output signal from the engine coolant temperature sensor 6 through I/O. Then, CPU calculates a value S from the output signal in relation to lapse of time after start of the engine E. After calculation of the value S, CPU reads out the value $K_2$ and multiplies it by the value S, and the multiplied value $K_2S$ is temporarily memorized. When CPU reads out correction-factors W and A from ROM in sequence, these factors A and W are multiplied by the value $K_2S$ and then memorized as a proportional constant $K_0$.

After calculation of the constant $K_0$, the program proceeds to a step 605. At this step 605, CPU receives digital numbers from the rotation speed detector 130 and also digital numbers from the analog-to-digital converter 200 which are inversely in proportion to an amount Q of sucked air. The digital numbers from the detector 130 are divided by the digital numbers from the converter 200, the divided value being in proportion to Q and inversely in proportion to N. In this step 605, the reciprocal of rotation number N and the divided value Q/N are temporarily memorized for use in calculation of the second data. When the program proceeds from the step 605 to a following step 606, CPU reads out the value Q/N and the constant $K_0$ to multiply them to each other. Thus, the multiplied value $K_0Q/N$ is transferred as a first data $D_\tau$ to the comparator 300*a* by I/O.

When CPU is triggered by the second timing pulse from the delay circuit 500, repeated is a service routine which is substantially the same as the above results. As a result, another calculated value $K_0Q/N$ is transferred as another first data $D_\tau$ to the comparator 300*b* by I/O.

From the above description, it will be understood that respective first data are repetitively calculated by the computer 100 when the first and second timing pulses from the delay circuit 500 are sequentially applied to CPU.

2. Computer Calculation of Second Data for Spark Plugs

Figure 1:
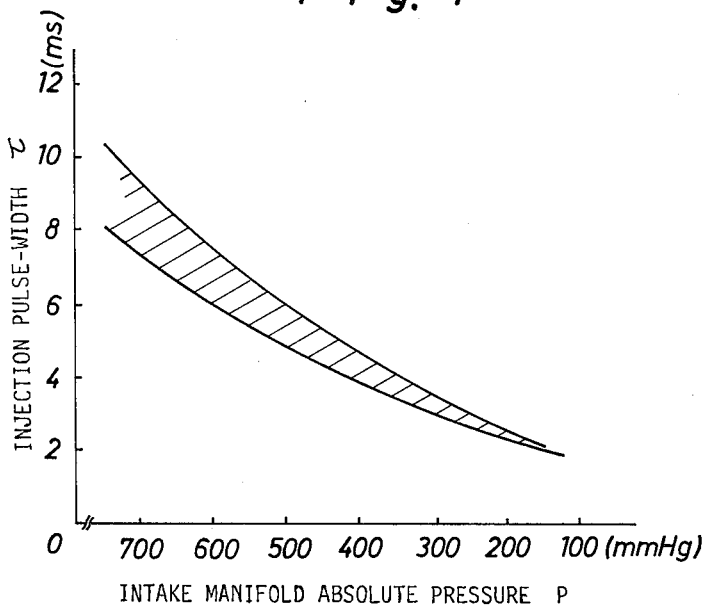
FIG. 1 is a graph of intake manifold absolute pressure P versus fuel injection pulse-width $\tau$.
Figure 2:
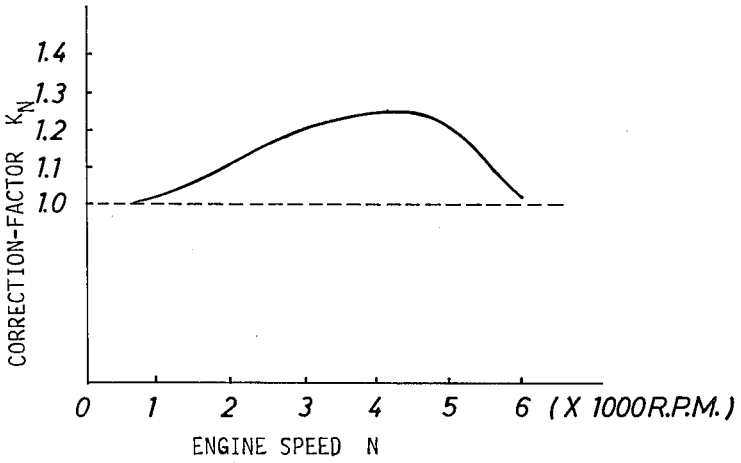
FIG. 2 is a graph of correction-factor $K_N$ versus engine speed N.
Figure 15:
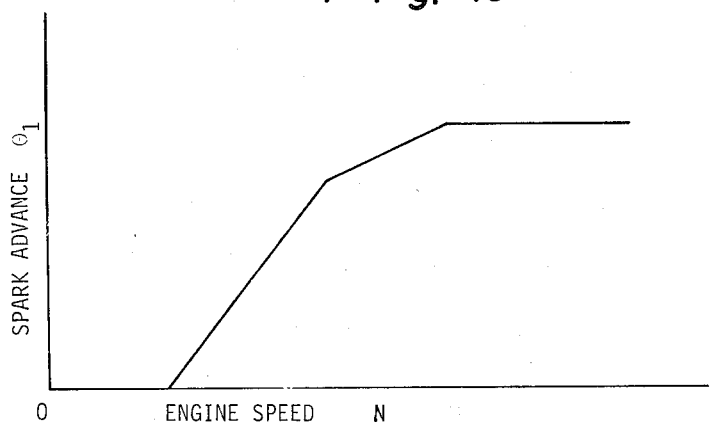
FIG. 15 is a graph of engine speed N versus spark advance $\theta_1$.
Figure 16:
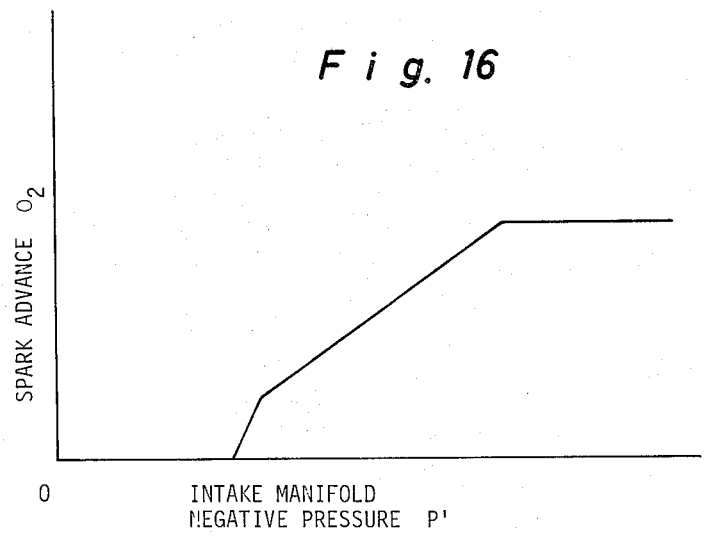
FIG. 16 is a graph of intake manifold negative pressure P' versus spark advance $\theta_2$.

A second data is calculated by the digital computer 100 from relationships given by the respective characteristic curves shown in FIGS. 1 and 2 and the characteristic curves shown in FIGS. 15 and 16. In FIG. 15, rotation speed advance angle $\theta_1$ is plotted on the ordinate axis and rotation number N is plotted on the abscissa. In FIG. 16, vacuum advance angle $\theta_2$ is plotted on the ordinate axis and intake manifold negative pressure P' is plotted on the abscissa. The relationships given by the curves shown in FIGS. 1, 2, 15 and 16 are previously memorized in ROM.

Figure 17:
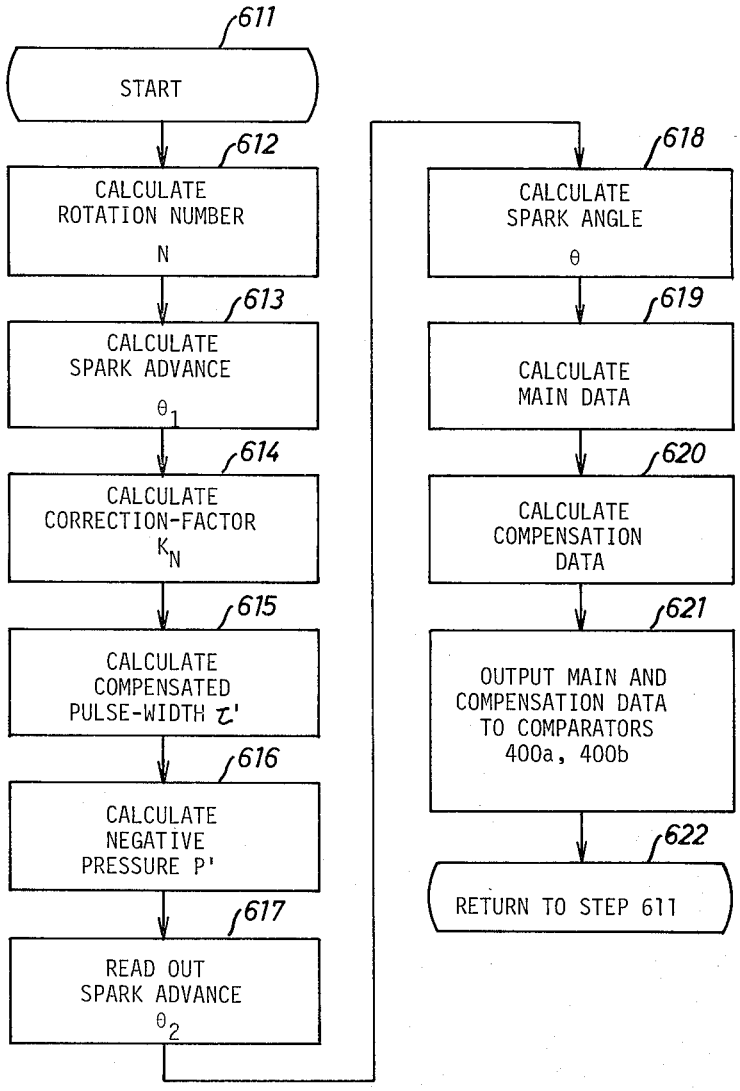
FIG. 17 is a flow diagram illustrating the operation of the digital computer as it is used to control ignition spark timing.

FIG. 17 is a flow diagram illustrating the calculation of the second data. In the flow diagram, at a step 611 the computer program is entered when CPU is triggered by the first output pulse from the electronic distributor 120. When the program proceeds to a step 612, CPU reads out the reciprocal of rotation number N to calculate rotation number N from the reciprocal 1/N. Then, at a step 613, a spark advance angle $\theta_1$ shown in FIG. 15 is read out from ROM in relation to the rotation number N. Subsequently at a step 614, a correction-factor $K_N$ shown in FIG. 2 is read out from ROM in relation to the rotation number N.

When the program proceeds to the following step 615, the value Q/N is read out and divided by the correction-factor $K_N$ obtained at the step 614. The divided value $Q/NK_N$ is represented as a compensated injection pulse-width $\tau'$ which corresponds with a pulse-width $\tau$ indicated by the bottom curve in FIG. 1. Then, the program proceeds to a step 616 in which an intake manifold absolute pressure P shown in FIG. 1 is read out from ROM in relation to the compensated pulse-width $\tau'$. Thereafter, an actual negative pressure P' is obtained by subtracting the absolute pressure P from the atmospheric pressure $P_0$.

At the following step 617, a vacuum advance angle $\theta_2$ shown in FIG. 16 is read out from ROM in relation to the negative pressure P'. The advance angles $\theta_1$ and $\theta_2$ obtained at the steps 613 and 617 are added to each other at a step 618 so that a desired or retard angle $\theta$ is obtained by subtracting the added value $\theta_1+\theta_2$ from a predetermined reference angle 60°. In this instance, the angle $\theta_1$ or $\theta_2$ is measured from the top dead center position of the piston in the advancing direction. When the program proceeds to a step 619, the advance angle $\theta$ is divided by 3.13° and the integer portion $[\theta/3.13]$ of the divided value $\theta/3.13$ is temporarily memorized as a main data. Subsequently, at a step 620 CPU subtracts the integral number portion $[\theta/3.13]$ from the divided value $\theta/3.13$. The subtracted value $\{\theta/3.13-[\theta/3.13]\}$ is divided by 3.13° and thereafter multiplied by a period T' of a rectanglar pulse which is generated by the wave shaping circuit 110 prior to the instant ignition timing of the engine E. Thus, the calculated value $\{\theta/3.13-[\theta/3.13]\}T'/3.13$ is obtained as a compensation data at this step 620. At a final step 621 the main and compensation data obtained at the steps 619 and 620 are transferred to the comparator 400*a* as the second data.

When CPU is triggered by the second output pulse from the distributor 120, repeated is a service routine which is substantially the same as the above routine. As a result, another main and compensation data are transferred as another second data to the comparator 400*b*.

Figure 18:
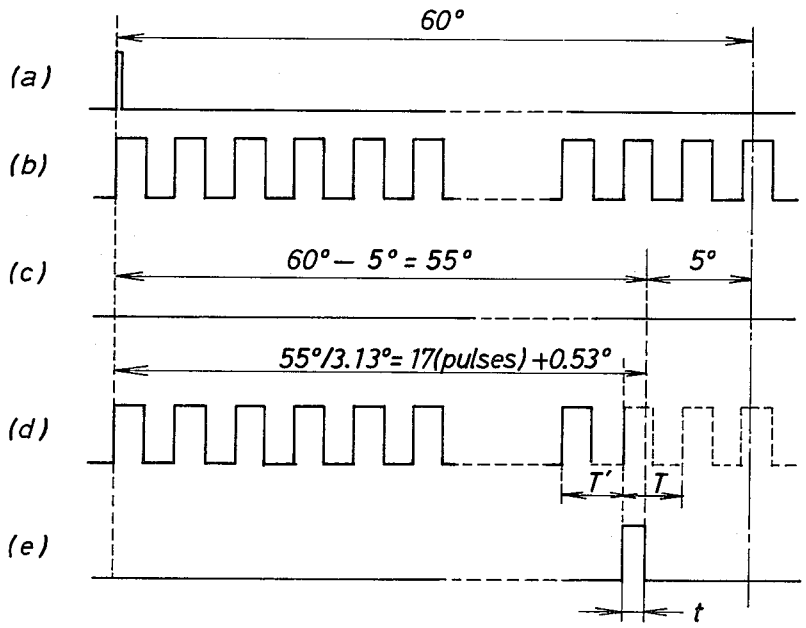
FIG. 18, including *a–e* is a waveform diagram indicating an example of calculation of the ignition spark timing.

FIG. 18 shows a time chart for an example of the above calculation. As shown in (a) of FIG. 18, a first output pulse is generated by the distributor 120 at a reference position corresponding with 60° before the top dead center position of the first piston. Waveforms shown in (b) and (c) of FIG. 18 respectively represent sequential rectangular pulses generated by the wave shaping circuit 110 and an ignition spark advance issued from the computer 100. Therefore, to set an ignition spark timing into 5° before the top dead center position, a second data corresponding with 55° has only to be calculated in the computer 100. When a compensation data t of the above second data are calculated, the theoretical following equation is used.

$$t=T\cdot(0.53/3.13) \qquad (9)$$

where T represents a period of the rectangular pulse detected after ignition timing, as shown in (d) of FIG. 18. In practice, used as the period T is a period T' of the rectangular pulse generated prior to the ignition timing.

Figure 19:
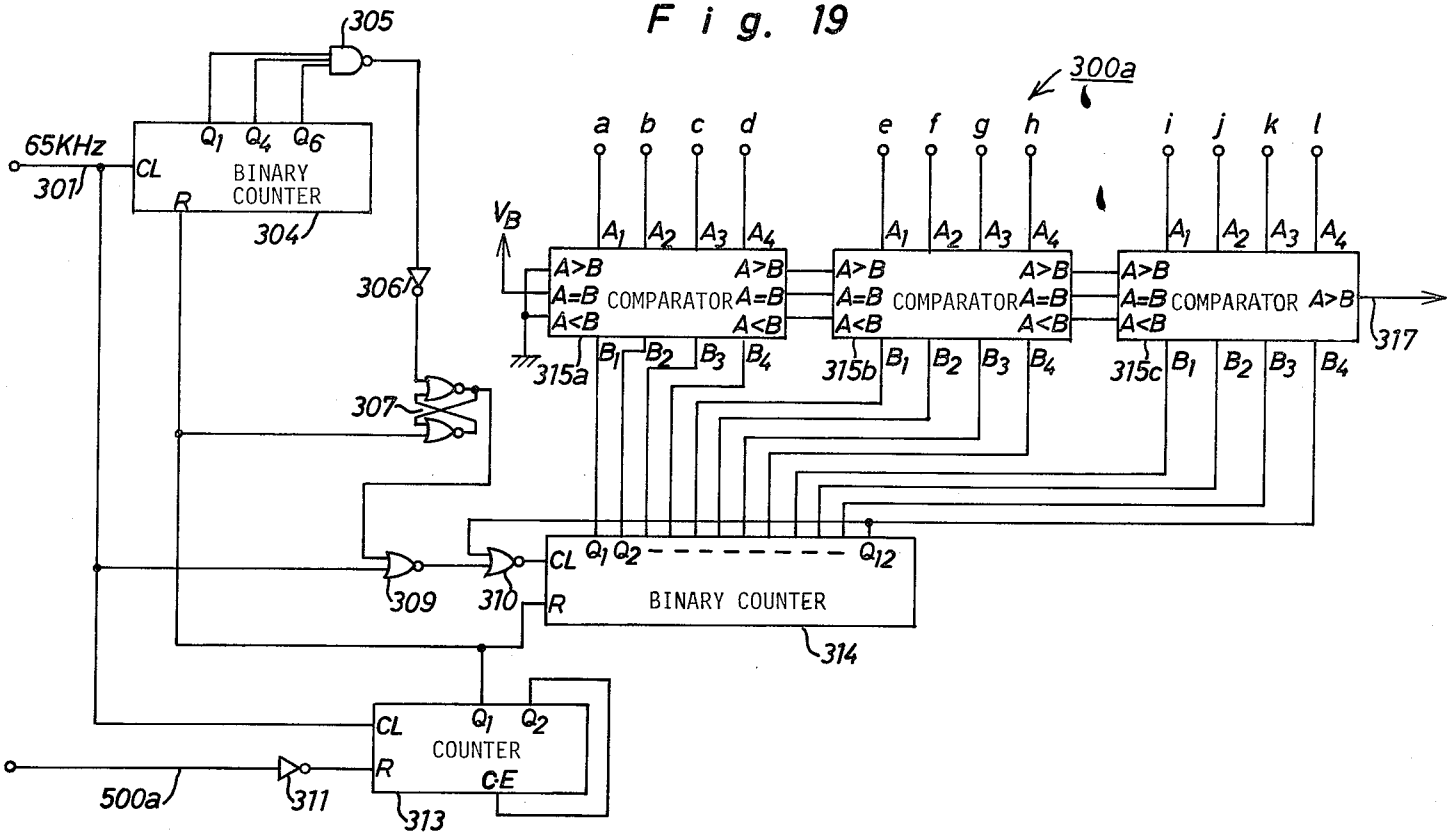
FIG. 19 is a circuit diagram of an embodiment of the comparator for the fuel injectors illustrated in block form in FIG. 3.
Figure 20:
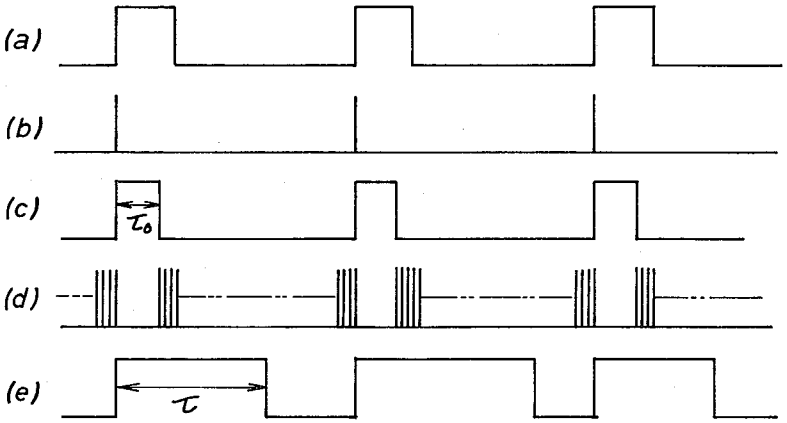
FIG. 20, including *a–e*, illustrates waveforms obtained at various points in the comparator of FIG. 19.

In FIG. 19, there is illustrated an embodiment of the comparator 300*a* which comprises a RS flip-flop 307 for generating an output pulse shown in (c) of FIG. 20 in response to output pulses from an inverter 306 and a decade counter 313. The counter 313 receives at its terminal CL clock pulses from the clock circuit 30 through a line 301. The counter 313 is reset upon receiving at its terminal R the first timing pulses (See (a) of FIG. 20) from the delay circuit 500 through the line 500*a* and an inverter 311 to generate at its terminal $Q_1$ an output pulse shown in (b) of FIG. 20. The output pulse from the counter 313 is applied to terminals R of binary counters 304 and 314 and a reset terminal of the RS flip-flop 307. The binary counter 304 also receives at its terminal CL the clock pulses from the clock circuit 30 through the line 301. When the counter 304 is reset by the output pulse from the counter 313, it generates low level signals at its respective terminals $Q_1$, $Q_4$ and $Q_6$ and counts the clock pulses up to forty-one to generate high level signals at its terminals $Q_1$, $Q_4$ and $Q_6$ respectively.

A NAND gate 305 receives at its input terminals the low level signal from the counter 304 to generate at its output terminal a high level signal which is applied to the inverter 306. The NAND gate 305 also receives at its input terminal the high level signal from the counter 304 to generate at its output terminal a low level signal which is applied to the inverter 306. The RS flip-flop 307 receives at its set terminal a low level signal from the inverter 306 to generate at its output terminal a high level signal with a duration $\tau_0$ shown in (c) of FIG. 20. The RS flip-flop 307 also receives at its set terminal a high level signal from the inverter 306 to generate at its output terminal a low level signal shown in (c) of FIG. 20. In the above description, the duration $\tau_0$ of the high level signal from the RS flip-flop 307 is predetermined as an energization time of each fuel injector 7*a* to 7*d* and corresponds with a total period of fourty-one clock pulses counted by the counter 304, as described above.

In the comparator 300*a*, a NOR gate 309 is provided to receive at its first input terminal the high level signal from the RS flip-flop 307 and also at its second input terminal the clock pulses from the clock circuit 30 through the line 301 to generate at its output terminal a low level signal shown in (d) of FIG. 20 which is applied through a NOR gate 310 to the counter 314. The NOR gate 309 also receives at its first input terminal the low level signal from the RS flip-flop 307 and at its second input terminal the clock pulses from the clock circuit 30 to generate at its output terminal sequential output pulses shown in (d) of FIG. 20 which are applied through the NOR gate 310 to the counter 314. The binary counter 314 is reset upon receiving the output signal from the counter 313 to count output pulses issued from the NOR gate 310. When output pulses appear at respective terminals $Q_1$ to $Q_{12}$ of the counter 314, they are applied to terminals $B_1$ to $B_4$ of comparators 315*a* to 315*c* of CD 4063 type manufactured by RCA Corporation.

The comparators 315*a* to 315*c* receive at their terminals $A_1$ to $A_4$ the first data from the computer 100 to compare the same with the output pulses from the counter 314. When the first data is larger than the output pulses from the counter 314, the comparator 315*c* generates at its terminal A>B a high level signal shown in (e) of FIG. 20. The high level signal of the comparator 315*c* is applied to the injector drive circuit 10*a* as an injection pulse with a pulse-width $\tau$. In this case, the pulse-width $\tau$ is larger than the pulse-width $\tau_0$ and a duration $(\tau-\tau_0)$ corresponds with an injection time of each fuel injector 7*a* to 7*d*. When the first data is equal to or smaller than the output pulses from the counter 314, the comparator 315*c* generates at its terminal A>B a low level signal shown in (c) of FIG. 20. In addition, the comparator 300*b* generates another injection pulse with a 180° phase lag in relation to the injection pulse issued from the comparator 300*a*. Other construction and function of the comparator 300b are substantially the same as those of the comparator 300a.

Figure 21:
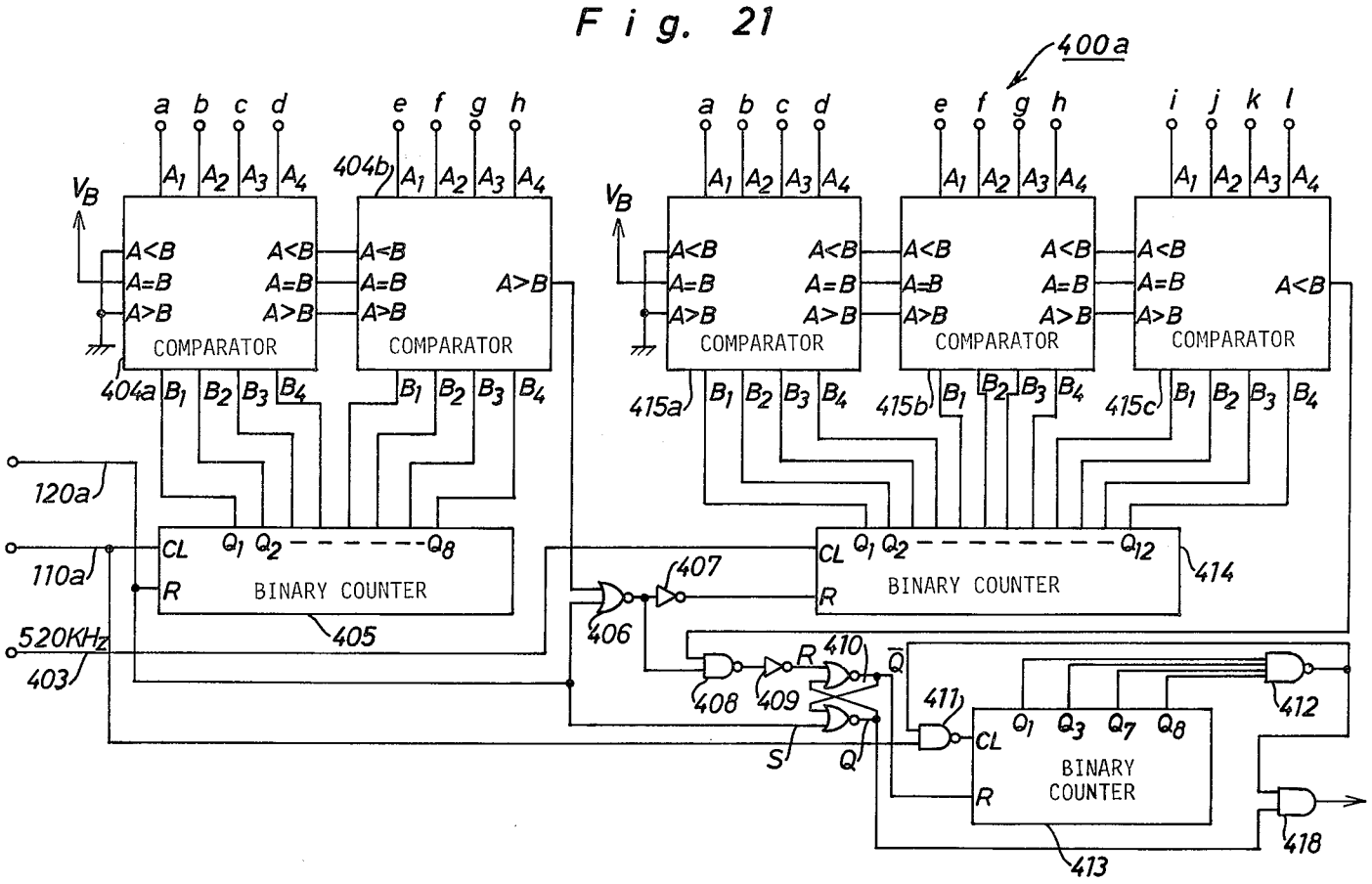
FIG. 21 is a circuit diagram of an embodiment of the comparator for the spark plugs illustrated in block form in FIG. 3.

FIG. 21 illustrates an embodiment of the comparator 400a which comprises comparators 404a and 404b for comparing the main data of the second data from the computer 100 with output pulses from a binary counter 405. The counter 405 receives at its terminal CL rectangular pulses from the wave shaping circuit 110 through the line 110a. When the counter 405 is reset upon receiving at its terminal R a first output pulses (See (a) of FIG. 22) from the distributor 120 through the line 120a, it counts the rectangular pulses to generate at its terminals $Q_1$ to $Q_8$ output signals respectively. The comparators 404a and 404b receive at its terminals $B_1$ to $B_4$ the output signals from the counter 405 and also at its terminals $A_1$ to $A_4$ the main data from the computer 1 through lines a to h. When the main data is larger than the output signals from the counter 405, the comparator 404b generates at its terminal A>B a high level signal with a duration $\theta'$ shown in (b) of FIG. 22. When the main data is equal to or smaller than the output signals from the counter 405, the comparator 404b generates at its terminal A>B a low level signal shown in (b) of FIG. 22.

In the comparator 400a, a NOR gate 406 is provided to receive at its input terminals the high level signal from the comparator 404b and the first output pulse from the distributor 120 to generate at its output terminal a low level signal. The low level signal is inverted by an inverter 407 and applied to a binary counter 414. When the counter 414 is reset upon receiving at its terminal R an output pulse from the inverter 407, it counts clock pulses issued from the clock circuit 30 through a line 403 to generate at its respective terminals $Q_1$ to $Q_{12}$ output signals which are applied to terminals $B_1$ to $B_4$ of comparators 415a to 415c. The comparators 415a to 415c also receive at their terminals $A_1$ to $A_4$ the compensation data of the second data from the computer 100 through lines a to l to compare it with the output pulses from the counter 414. When the compensation data is smaller than the output signals from the counter 414, the comparator 415c generates at its terminal A<B a low level signal shown in (c) of FIG. 22 which is applied to a NAND gate 408. When the compensation data are equal to or larger than the output signals from the counter 414, the comparator 415c generates at its terminal A<B a high level signal shown in (c) of FIG. 22 which is applied to the NAND gate 408.

The NAND gate 408 receives at its input terminals the low level signals from the NOR gate 406 and the comparator 415c to generate at its output terminal a high level signal. The high level signal from the NAND gate 408 is inverted by an inverter 409 and applied as a low level signal to a RS flip-flop 410. The NAND gate 408 also receives at its input terminals the high level signals from the NOR gate 406 and the comparator 415c to generate at its output terminal a low level signal. The low level signal from the NAND gate 408 is inverted by the inverter 409 and applied as a high level signal to the RS flip-flop 410. The RS flip-flop 410 receives at its respective terminals R and S the low level signal from the inverter 409 and the first output pulse from the distributor 120 to generate at its respective terminals $\overline{Q}$ and Q high and low level signals. When the RS flip-flop 410 receives at its terminal R the high level signal from the inverter 409 to generate a low level signal at its terminal Q and a high level signal at its terminal $\overline{Q}$. The low or high level signal appearing at the terminal $\overline{Q}$ of the RS flip-flop 410 is applied to a binary counter 413, whereas the high or low level signal appearing at the terminal Q of the RS flip-flop 410 is applied to an AND gate 418.

The binary counter 413 receives at its terminal CL the rectangular pulses from the wave shaping circuit 110 through a NAND gate 411. When the counter 413 is reset upon receiving at its terminal R the high level signal from the terminal $\overline{Q}$ of the RS flip-flop 410, it generates low level signals at its respective terminals $Q_1$, $Q_3$, $Q_7$ and $Q_8$ and also counts output pulses issued from the NAND gate 411 to generate high level signals at its terminals $Q_1$, $Q_3$, $Q_7$ and $Q_8$. A NAND gate 412 receives at its input terminals the low level signals from the counter 413 to generate a high level signal at its output terminal. The NAND gate 412 also receives at its input terminals the high level signals from the counter 413 to generate a low level signal at its output terminal.

The NAND gate 411 receives at its input terminals the high level signal from the NAND gate 412 and the rectangular pulses from the wave shaping circuit 110 to generate output pulses therefrom. The NAND gate 411 also receives at its input terminals the low level signals from the NAND gate 412 and the rectangular pulses from the circuit 110 to generate at its output terminal a high level signal. The AND gate 418 receives at its input terminal the high level signal from the NAND gate 412 and the low level signal from the terminal Q of the RS flip-flop 410 to generate at its output terminal a low level signal shown in (e) of FIG. 22. The AND gate 418 also receives at its input terminals the high level signals from the NAND gate 412 and the terminal Q of RS flip-flop 410 to generate at its output terminal a high level signal shown in (e) of FIG. 22.

Figure 22:
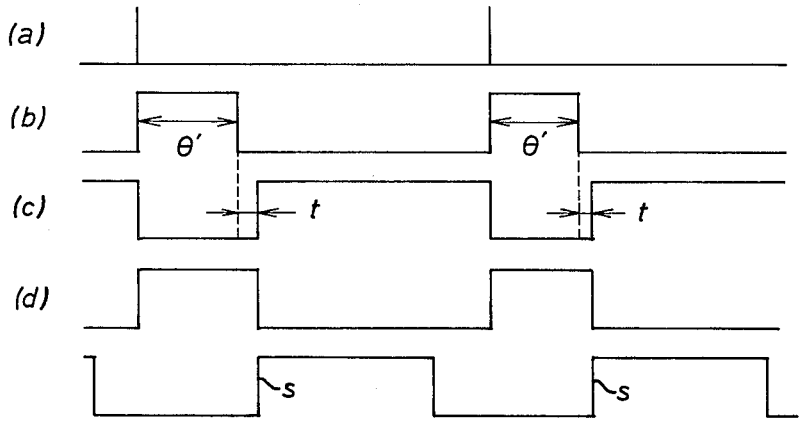
FIG. 22, including *a–d*, illustrates waveforms obtained at various points in the comparator of FIG. 21.

From the above description, it will be understood that the main and second data respectively correspond with the duration $\phi'$ of the high level signal of the comparator 404b and a duration t indicated in (c) of FIG. 22, and also a leading edge s of the high level signal of the AND gate 418 corresponds with ignition timing of the engine E as shown in (e) of FIG. 22. In addition, the comparator 400b provides another ignition timing with a 180° phase lag in relation to the ignition timing provided by the comparator 400a. Other construction and function of the comparator 400b are substantially the same as those of the comparator 400a.

Figure 23:
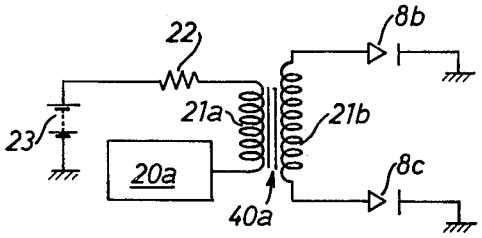
FIG. 23 is a circuit diagram of an embodiment of the ignition control illustrated in block form in FIG. 3.
Figure 24:
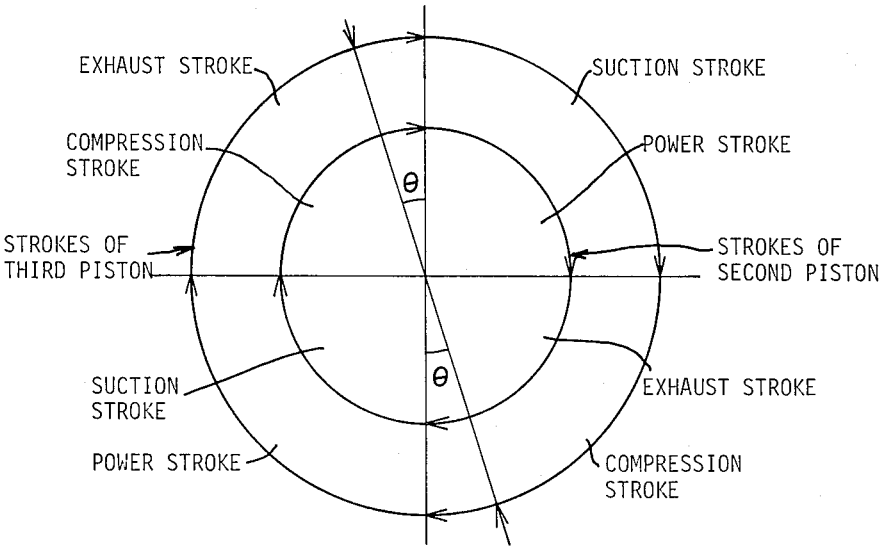
FIG. 24 is a diagram for explaining energization timing of the ignition coil.

In FIG. 23, the ignition coil 40a comprises a primary winding 21a interposed between the ignitor 20a and a resistor 22 connected to a battery 23. The secondary winding 21b of the ignition coil 40a is interposed between the second and third spark pulgs 8b and 8c. When the ignition coil 40a is energized by the ignitor 20a, the second and third spark plugs 8b and 8c are respectively activated under compression and exhaust strokes of the second and third cylinders at an angular point $\phi$ as shown in FIG. 24. In this case, the second spark plug 8b mainly sparks because pressure in the second cylinder is higher than exhaust pressure in the third cylinder. In addition, the ignition coil 40b has substantially the same construction and function as the ignition coil 40a.

Having now fully set forth both structured and operation of a preferred embodiment of the concept underlying the present invention, various other embodiments as well as certain variations and modifications of the embodiment herein shown and described will obviously occur to those skilled in the art upon becoming familiar with said underlying concept. It is to be understood, therefore, that within the scope of the appended claims, the invention may be practiced otherwise than as specifically set forth herein.

What is claimed is:

1. A method for controlling a combustion engine having an output shaft driven by mechanical energy converted from heat energy caused by the combustion of air-fuel mixture, said engine being provided thereon with first control means for controlling the amount of fuel metered into said engine and second control means for controlling the timing of sparks supplied to said engine, the method comprising the steps of:

a. generating a binary number electric signal indicative of the amount of air flowing into said engine;
b. generating a binary number electric signal indicative of rotation speed of said output shaft during operation of said engine;
c. detecting a predetermined angular position of said output shaft before the arrival of a piston to its top dead center to generate a reference signal per one rotation of said output shaft;
d. generating a timing signal with a predetermined phase lag in relation to the reference signal;
e. calculating a first value corresponding to setting of said first control means by a computer programmed to calculate the first value from a first function describing a desired relationship among setting of said first control means, the amount of air flowing into said engine and the rotation speed of said output shaft, the calculation of the first value being performed by using the binary number electric signals upon receiving the timing signal;
f. calculating an actual intake manifold pressure by said computer programmed to calculate the actual intake manifold pressure from a second function describing a relationship between an intake manifold absolute pressure and the calculated first value;
g. calculating a second value corresponding to setting of said second control means by said computer programmed to calculate the second value from a third function describing a desired relationship between setting of said second control means and the calculated intake manifold pressure, the calculation of the second value being performed by using the binary number electric signals upon receiving the reference signal;
h. converting the first and second calculated values into the settings of said first and second control means respectively in response to the timing signal and the reference signal; and
i. continuously repeating the above sequence of steps for controlling the amount of fuel and the timing of sparks in response to changes of the binary number electric signals.

2. A method for controlling a combustion engine having an output shaft driven by mechanical energy converted from heat energy caused by the combustion of air-fuel mixture, said engine being provided thereon with first control means for controlling the amount of fuel metered into said engine and second control means for controlling the timing of sparks supplied to said engine, the method comprising the steps of:

a. generating a binary number electric signal indicative of the amount of air flowing into said engine;
b. generating a binary number electric signal indicative of rotation speed of said output shaft during operation of said engine;
c. detecting first and second predetermined angular positions of said output shaft before the arrival of a piston to its top dead center to generate first and second reference signals per one rotation of said output shaft;
d. calculating a first value corresponding to setting of said first control means by a computer programmed to calculate the first value from a first function describing a desired relationship among setting of said first control means, the amount of air flowing into said engine and the rotation speed of said output shaft, the calculation of the first value being performed by using the binary number electric signals upon receiving the first reference signal;
e. calculating an actual intake manifold pressure by said computer programmed to calculate the actual intake manifold pressure from a second function describing a relationship between an intake manifold absolute pressure and the calculated first value;
f. calculating a second value corresponding to setting of said second control means by said computer programmed to calculate the second value from a third function describing a desired relationship between setting of said second control means and the calculated intake manifold pressure, the calculation of the second value being performed by using the binary number electric signals upon receiving the second reference signal;
g. converting the first and second calculated values into the settings of said first and control means respectively in response to the first and second reference signals; and
h. continuously repeating the above sequence of steps for controlling the amount of fuel and the timing of sparks in response to changes of the binary number electric signals.

* * * * *